United States Patent [19]

Marsh

[11] Patent Number: 4,867,423

[45] Date of Patent: Sep. 19, 1989

[54] SPRING ASSEMBLY HAVING REINFORCED EDGE CONSTRUCTION

[75] Inventor: John C. Marsh, London, Canada

[73] Assignee: Lear Siegler, Inc., Berkley, Mich.

[21] Appl. No.: 237,676

[22] Filed: Aug. 25, 1988

Related U.S. Application Data

[63] Continuation of Ser. No. 538,762, Oct. 3, 1983, abandoned.

[51] Int. Cl.[4] ..... F16F 3/04; A47C 27/00

[52] U.S. Cl. ..... 267/91; 5/474; 267/97

[58] Field of Search ..... 267/80, 91, 92, 95, 267/97, 101, 103, 105; 297/455; 5/474, 475, 260, 248, 246

[56] References Cited

U.S. PATENT DOCUMENTS

| | | | |
|---|---|---|---|
| 3,590,404 | 7/1971 | Dreve, Jr. | 5/474 X |
| 4,000,531 | 1/1977 | Inman | 5/260 X |
| 4,051,567 | 10/1977 | Hutchinson | 5/260 |

FOREIGN PATENT DOCUMENTS

| | | | |
|---|---|---|---|
| 2705956 | 12/1977 | Fed. Rep. of Germany | 267/91 |
| 0956351 | 4/1964 | United Kingdom | 267/92 |
| 1207717 | 10/1970 | United Kingdom | 267/80 |

*Primary Examiner*—Robert J. Oberleitner
*Attorney, Agent, or Firm*—Brooks & Kushman

[57] ABSTRACT

A rectangular spring assembly (10,10') of the continuous coil type is disclosed as including continuous coil edge reinforcers (20) at a first set of opposite margins (12) between which continuous coils (16) extend. Additional edge reinforcers (24,24') are also preferably provided at a second set of opposite margins (14) of the assembly. In one embodiment, the spring assembly (10) has its edge reinforcers (20,24) oriented with straight connectors (30) thereof located adjaent associated border wires (34) and preferably has the edge reinforcers all made unitary with each other. In another embodiment, the spring assembly (10') has the straight connector portions (30) of its edge reinforcers (24') spaced inwardly from the border wires (34) with the edge reinforcers (20) made separate from the edge reinforcers (24').

10 Claims, 2 Drawing Sheets

SPRING ASSEMBLY HAVING REINFORCED EDGE CONSTRUCTION

This is a continuation of co-pending application Ser. No. 538,762 filed on Oct. 3, 1983, now abandoned.

TECHNICAL FIELD

This invention relates to an improved reinforced edge construction for a rectangular spring assembly of the continuous coil type.

BACKGROUND ART

Rectangular spring assemblies of the continuous coil type conventionally include continuous coil springs that extend between a first set of opposite edges or margins while extending in a parallel relationship to each other. Such spring assemblies are desirable in that the continuous coil springs do not have to have each coil thereof individually secured as is the case with spring assemblies made from individual coil springs. To provide edge reinforcement, prior continuous coil spring assemblies have also included a double row of continuous coil springs at the second set of opposite margins. However, heretofore, it has not been possible to provide any reinforcement of the first set of opposite edges of continuous coil springs adjacent which the endmost coils of each spring are located.

DISCLOSURE OF INVENTION

An object of the present invention is to provide an improved edge reinforcement construction for a rectangular spring assembly of the continuous coil type.

In carrying out the above object, a spring assembly incorporating the invention has a rectangular shape with first and second sets of opposite margins. A plurality of continuous coil springs of the assembly each include a plurality of coils made unitary with each from a continuous strand of wire. The continuous coil springs extend between the first set of opposite margins of the spring assembly in a parallel relationship to each other and to the second set of opposite margins. Continuous coil edge reinforcers are provided for the first set of opposite margins of the spring assembly. Each of the continuous coil edge reinforcers includes a plurality of coils made unitary with each other from a continuous strand of wire. The continuous coil edge reinforcers extend parallel to the first set of opposite margins with the coils thereof interengaged with the endmost coils of the continuous coil springs extending between the first set of opposite margins.

With the construction of this spring assembly, edge reinforcement is provided to the endmost coils of the continuous coil springs in a manner that was not previously possible.

In the preferred practice of the invention, additional continuous coil edge reinforcers are also provided for the second set of opposite margins of the spring assembly. Each of the additional continuous coil edge reinforcers includes a plurality of coils made unitary with each other from a continuous strand of wire. The additional continuous coil edge reinforcers extend parallel to the second set of opposite margins with the coils thereof interengaged with the coils of the adjacent continuous coil springs extending between the first set of opposite margins.

In the preferred construction, the coils of each continuous coil spring and edge reinforcer include loops that receive each other in an interlocking fashion and also include straight connector portions that connect the adjacent loops. The connector portions of the edge reinforcers are aligned with each other in a laterally spaced relationship on one side of the coils. As disclosed, the straight connector portions have bent ends connected to the adjacent coils.

Two preferred embodiments of the spring assembly disclosed each include a pair of rectangular border wires. One of these embodiments has the connector portions of the continuous coil edge reinforcers secured to the border wires in an adjacent relationship and, most preferably, has the edge reinforcers constructed unitary with each other from a single continuous coil spring that may have the identical construction as the other continuous coil springs of the spring assembly. The other preferred embodiment of the spring assembly has the connector portions of the edge reinforcers associated with the first set of opposite margins secured to the border wires in an adjacent relationship and has the connector portions of the edge reinforcers for the second set of opposite margins spaced inwardly from the border wires.

As disclosed, the spring assembly has an elongated rectangular shape with a longer dimension between the first set of opposite margins than between the second set of opposite margins which is a construction that has particular utility when the spring assembly is used for bedding purposes. However, it should also be recognized that the spring assembly can be utilized for furniture as well and that the rectangular shape thereof can be square.

The objects, features, and advantages of the present invention are readily apparent from the following detailed description of the best modes for carrying out the invention when taken in connection with accompanying drawings.

BEST MODES FOR CARRYING OUT THE INVENTION

Figure 1:
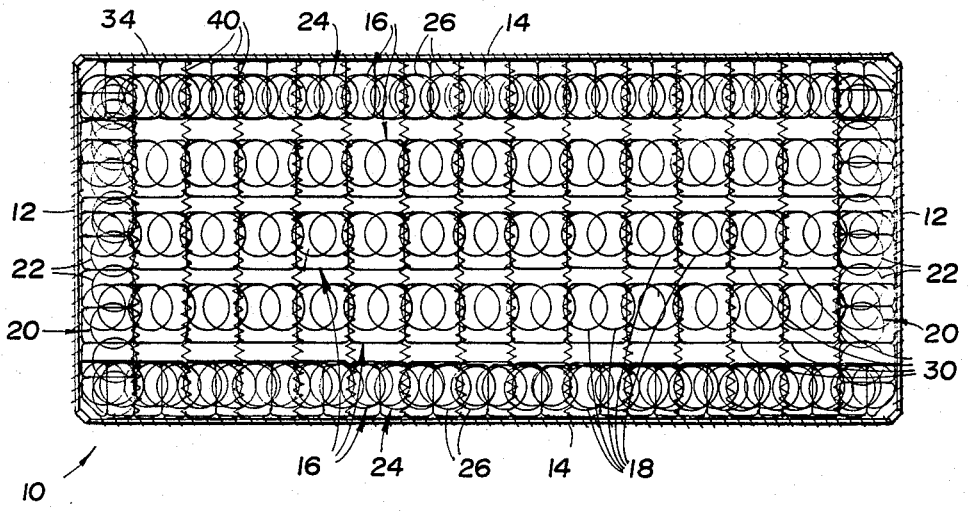
FIG. 1 is a plan view of a spring assembly constructed in accordance with the present invention.
Figure 2:
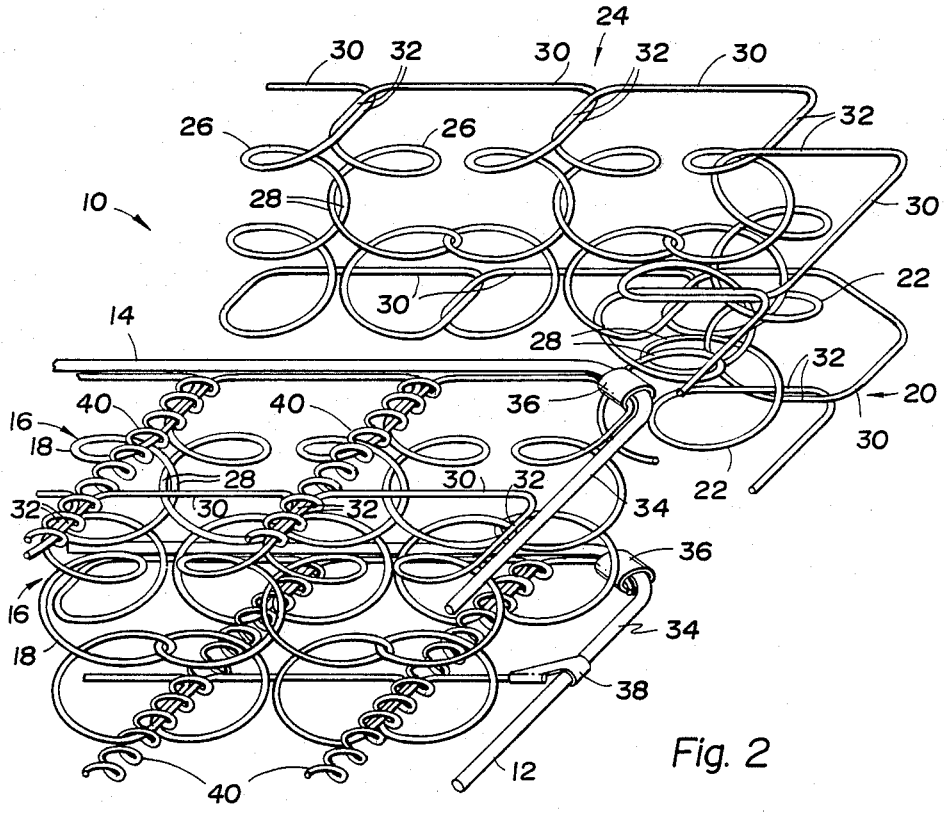
FIG. 2 is an exploded perspective view of a corner of the spring assembly shown in FIG. 1.

With reference to FIGS. 1 and 2 of the drawings, a spring assembly constructed in accordance with the present invention is generally indicated by 10 and has a generally rectangular shape with first and second sets of opposite edges or margins 12 and 14. The spring assembly 10 has an elongated rectangular shape as illustrated with a longer length between the first set of opposite margins 12 than between the second set of opposite margins 14, which is a construction that has utility for bedding usage. However, it should be understood that the spring assembly 10 can also be utilized for furniture and, in such usage, its rectangular shape may advantageously be square with equal distances between the first and second sets of opposite margins.

With continuing reference to FIGS. 1 and 2, the spring assembly 10 includes a plurality of continuous coil springs 16 each of which includes a plurality of coils 18 made unitary with each other from a continuous strand of wire. Continuous coil springs 16 extend as shown in FIG. 1 between the first set of opposite margins 12 of the spring assembly in a parallel relationship to each other and to the second set of opposite margins 14. At the first set of opposite margins 12, continuous coil edge reinforcers are provided as generally indicated by 20. Each of the continuous coil edge reinforcers 20 includes a plurality of coils 22 made unitary with each other from a continuous strand of wire. These continuous edge reinforcers 20 extend parallel to the first set of opposite margins 12 with the coils 22 thereof interengaged with the endmost coils 18 of the continuous coil springs 16 extending between the first set of opposite margins.

The construction of the spring assembly 10 shown in FIGS. 1 and 2 provides increased edge support to the first set of opposite margins 12 in a manner not previously possible. Such increased edge support helps in preventing the springs from taking a set when overloaded and also provides firmer edge feel when a force is applied to the edge of the assembly.

In its preferred construction, the spring assembly 10 shown in FIGS. 1 and 2 also includes additional continuous coil edge reinforcers 24 for the second set of opposite margins 14. Each of these additional continuous coil edge reinforcers 24 includes a plurality of coils 26 made unitary with each from a continuous strand of wire. The continuous coil edge reinforcers 24 extend parallel to the second set of opposite margins 14 with the coils 26 thereof interengaged with the coils 18 of the adjacent continuous coil springs 16 extending between the first set of opposite margins 12. Edge reinforcers 24 thus cooperate with the edge reinforcers 20 to provide increased support around the entire periphery of the spring assembly 10.

With particular reference to FIG. 2, the coils 22 and 26 of the continuous coil edge reinforcers 20 and 24, as well as the coils 18 of the continuous coil springs 16, each include loops 28 that receive each other in an interlocking fashion. Springs 16 and edge reinforcers 20 and 24 also include straight connector portions 30 whose opposite ends 32 are bent at right angles and connected to the adjacent coil loops 28. The straight connector portions 30 connecting the loops 28 are aligned with each other in a laterally spaced relationship on one side of the associated spring coils as best seen in FIG. 1. Likewise, the coils 18 of the continuous coil springs 16 include loops 28 that receive each other in an interlocking fashion.

As illustrated in FIG. 2, spring assembly 10 includes a pair of rectangular border wires 34 located at the upper and lower extremities of the spring assembly. Both the edge reinforcers 20 and the edge reinforcers 24 are positioned with the connector portions 30 thereof located outwardly from the associated spring coils. Upon insertion of the coils of the edge reinforcers 20 and 24 into interengagement with the coils of the springs 16, the straight connector portions 30 are located adjacent the border wires 34 and are secured by any suitable type of clip, the clips 36 and 38 shown being only examples of types which can be used. Connector coils 40 are also utilized to connect the continuous coil springs 16 to each other and to the border wires 34. Also, the edge reinforcers 20 and 24 as illustrated in FIG. 2 are preferably made unitary with each other such that a single continuous coil spring provides the edge reinforcement around the entire periphery of the spring assembly in cooperation with the other continuous coil springs of the assembly. However, it is also possible to manufacture the edge reinforcers as separate components or with two reinforcers combined such that four or two piece edge reinforcers are used with each spring assembly.

Figure 3:
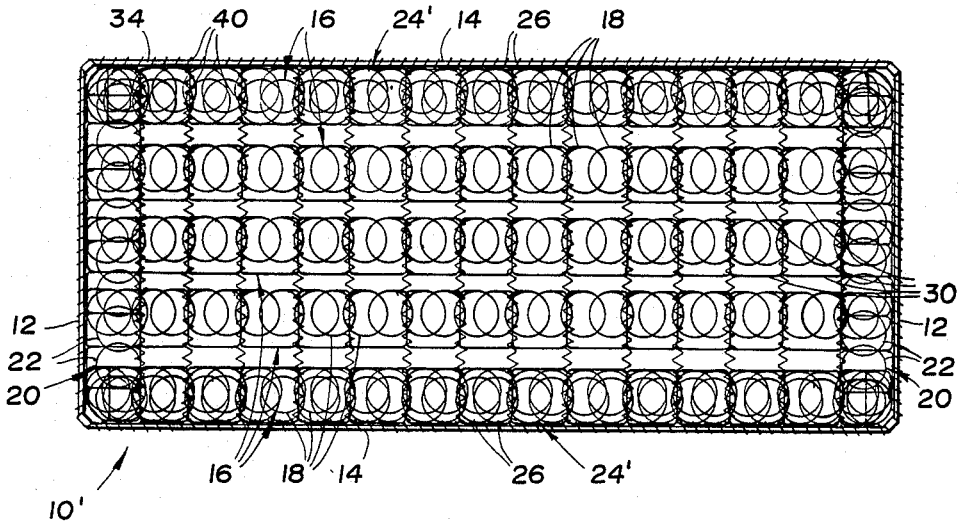
FIG. 3 is a plan view of another embodiment of a spring assembly constructed in accordance with the present invention.
Figure 4:
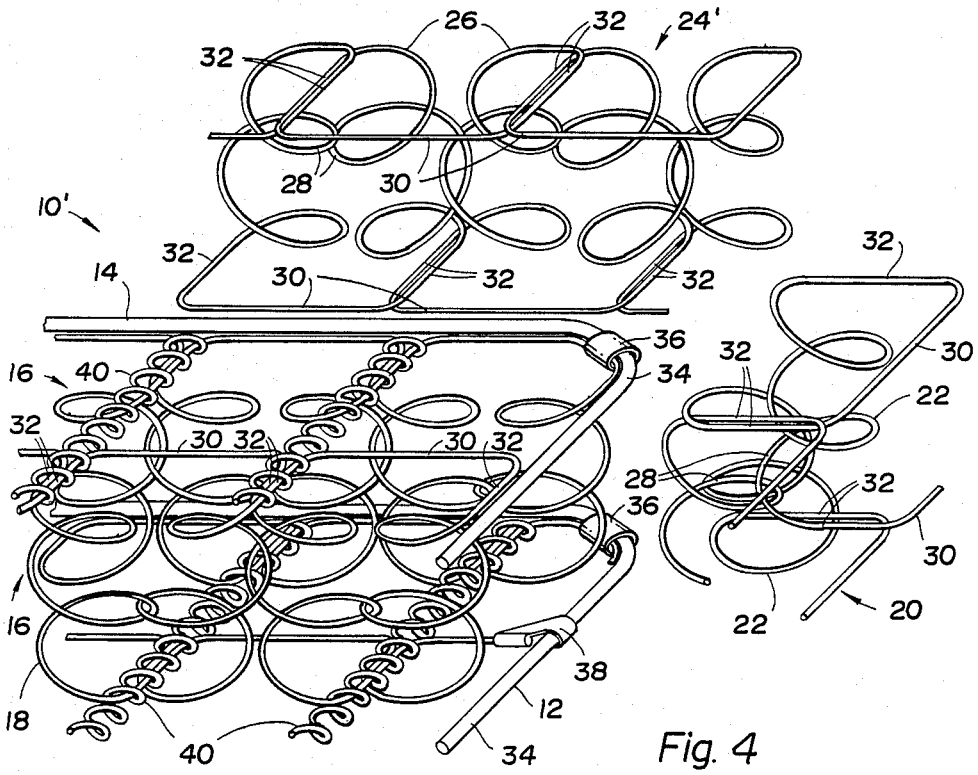
FIG. 4 is an exploded perspective view of a corner of the spring assembly shown in FIG. 3.

With reference to FIGS. 3 and 4, another preferred embodiment of the spring assembly is indicated generally by 10' and has the same construction as the previously described embodiment except as will be noted. As such, the corresponding components are identified by like reference numerals and the previous description is applicable such that no repetition thereof is necessary.

Spring assembly 10' shown in FIGS. 3 and 4 has edge reinforcers 24' at the second set of opposite margins 14 which have an identical construction to the edge reinforcers 24 previously described but are oriented oppositely. As such the straight connector portions 30 of the edge reinforcers 24' are located inwardly from the coils 26 thereof and are thus spaced inwardly from the associated border wires 34. When the continuous coil springs 16 are oriented with their straight connector portions 30 all located on the same side of the associated coils 18, positioning of the edge reinforcers 24' with the straight connector portions 30 located inwardly from the border wires 34 fills the gap between the border wire and the first and second continuous coil spring 16 on one side of the spring assembly and thereby provides a more continuous surface for supporting padding that is utilized with spring assembly. Normally, the edge reinforcer 20 will have the same orientation as the previously described embodiment of the spring assembly such that the straight connector portions 30 thereof are located adjacent the border wires 34 as opposed to being located inwardly therefrom as with the edge reinforcers 24'. As such, the reinforcers 20 and 24' are made separate from each other such that the spring assembly 10' has four separate edge reinforcers.

While the best modes for carrying out the invention have been described in detail, those familiar with the art to which this invention relates will recognize various alternatives, designs and embodiments for practicing the invention as defined by the following claims.

What is claimed is:

1. A spring assembly of a generally rectangular shape having first and second sets of opposite margins, the spring assembly comprising: a plurality of continuous coil springs each of which includes a plurality of coils made unitary with each other from a continuous strand of wire; said continuous coil springs extending between the first set of opposite margins of the spring assembly in a parallel relationship to each other and to the second set of opposite margins; continuous coil edge reinforcers for the first and second sets of opposite margins of the spring assembly; each of said continuous coil edge reinforcers including a plurality of coils made unitary with each other from a continuous strand of wire; the coils of each continuous coil spring and edge reinforcer including loops that receive the loops of the associated spring in an interlocking fashion and also including straight connector portions that connect the loops thereof and are aligned with each other in a laterally spaced relationship on one side of the coils; the continuous coil edge reinforcers associated with the first set of opposite margins extending parallel thereto with the coils thereof interengaged with the endmost coils of the continuous coil springs extending between the first set of opposite margins; the continuing coil edge reinforcers associated with the second set of opposite margins having the straight connector portions thereof located outwardly from the coils thereof; and a pair of rectangular border wires secured to the continuous coil springs and the edge reinforcers.

2. A spring assembly as in claim 1 wherein the continuous coil edge reinforcers for both the first and second sets of opposite margins have the connector portions thereof secured to the border wires in an adjacent relationship.

3. A spring assembly as in claim 1 wherein the continuous coil edge reinforcers are all unitary with each other.

4. A spring assembly as in claim 1 wherein the continuous coil edge reinforcers for the first set of opposite margins have the connector portions thereof secured to the border wires in an adjacent relationship, and the continuous coil edge reinforcers all being unitary with each other.

5. A spring assembly of a generally rectangular shape having first and second sets of opposite margins, the spring assembly comprising: a plurality of continuous coil springs each of which includes a plurality of coils made unitary with each other from a continuous strand of wire; the coils of said continuous coil springs including loops that receive each other in an interlocking relationship; said continuous coil springs also including straight connector portions that connect the coils thereof and are aligned with each other in a laterally spaced relationship at one side of the coils; the continuous coil springs extending between the first set of opposite margins of the spring assembly in a parallel relationship to each other and to the second set of margins; a pair of rectangular border wires that define the first and second sets of opposite margins; and continuous coil edge reinforcers for the first and second sets of opposite margins of the spring assembly, each edge reinforcer including a plurality of coils made unitary with each other from a continuous strand of wire, the coils of said edge reinforcers including loops that receive each other in an interlocking relationship, said edge reinforcers also including straight connector portions that connect the coils thereof and are aligned with each other in a laterally spaced relationship at one side of the coils, the edge reinforcers associated with the first set of opposite margins extending parallel thereto and having the coils thereof interengaged with the endmost coils of the continuous coil springs extending between the first set of opposite margins, said edge reinforcers associated with the first set of opposite margins having the straight connector portions thereof located outwardly from the coils thereof and secured to the border wires in an adjacent relationship, the edge reinforcers associated with the second set of opposite margins extending parallel thereto and having the coils thereof interengaged with the coils of the continuous coil springs adjacent the second set of opposite margins, and the edge reinforcers associated with the second set of opposite margins having the straight connector portions thereof located outwardly from the coils thereof and secured to the border wires in an adjacent relationship.

6. A spring assembly as in claim 1 or 5 which has an elongated rectangular shape with a longer dimension between the first set of opposite margins than between the second set of opposite margins.

7. A spring assembly of a generally rectangular shape having first and second sets of opposite margins, the spring assembly comprising: a plurality of continuous coil springs each of which includes a plurality of coils made unitary with each other from a continuous strand of wire; said continuous coil springs extending between the first set of opposite margins of the spring assembly in a parallel relationship to each other and to the second set of opposite margins; continuous coil edge reinforcers for the first and second sets of opposite margins of the spring assembly; each of said continuous coil edge reinforcers including a plurality of coils made unitary with each other from a continuous strand of wire; the coils of each continuous coil spring and edge reinforcer including loops that receive the loops of the associated spring in an interlocking fashion and also including straight connector portions that connect the loops thereof and are aligned with each other in a laterally spaced relationship on one side of the coils; the continuous coil edge reinforcers associated with the first set of opposite margins extending parallel thereto with the coils thereof interengaged with the endmost coils of the continuous coil springs extending between the first set of opposite margins; the continuing coil edge reinforcers associated with the second set of opposite margins having the straight connector portions thereof located inwardly from the coils of said reinforcers.

8. A spring assembly of a generally rectangular shape having first and second sets of opposite margins, the spring assembly comprising:

a plurality of continuous coil springs each of which includes a plurality of coils made unitary with each other from a continuous strand of wire;

said continuous coil springs extending between the first set of opposite margins of the spring assembly in a parallel relationship to each other and to the second set of opposite margins;

continuous coil edge reinforcers for the first and second sets of opposite margins of the spring assembly;

each of said continuous coil edge reinforcers including a plurality of coils made unitary with each other from a continuous strand of wire;

the coils of each continuous coil spring and edge reinforcer including loops that receive the loops of the associated spring in an interlocking fashion and also including straight connector portions that connect the loops thereof and are aligned with each other in a laterally spaced relationship on one side of the coils;

the continuous coil edge reinforcers associated with the first set of opposite margins extending parallel thereto with the coils thereof interengaged with the endmost coils of the continuous coil springs extending between the first set of opposite margins;

the continuous coil edge reinforcers associated with the second set of opposite margins having the straight connector portions thereof located outwardly from the coils thereof;

and a pair of rectangular border wires secured to the continuous coil springs and the edge reinforcers;

wherein the continuous coil edge reinforcers for both the first and second sets of opposite margins have the connector portions thereof secured to the border wires in an adjacent relationship;

and wherein the continuous coil edge reinforcers are all unitary with each other.

9. A spring assembly of a generally rectangular shape having first and second sets of opposite margins, the spring assembly comprising:

a plurality of continuous coil springs each of which includes a plurality of coils made unitary with each other from a continuous strand of wire;

the coils of said continuous coil springs including loops that receive each other in an interlocking relationship;

said continuous coil springs also including straight connector portions that connect the coils thereof and are aligned with each other in a laterally spaced relationship at one side of the coils;

the continuous coil springs extending between the first set of opposite margins of the spring assembly in a parallel relationship to each other and to the second set of margins;

a pair of rectangular border wires that define the first and second sets of opposite margins;

and continuous coil edge reinforcers for the first and second sets of opposite margins of the spring assembly, each edge reinforcer including a plurality of coils made unitary with each other from a continuous strand of wire, the coils of said edge reinforcers including loops that receive each other in an interlocking relationship, said edge reinforcers also including straight connector portions that connect the coils thereof and are aligned with each other in a laterally spaced relationship at one side of the coils;

the edge reinforcers associated with the first set of opposite margins extending parallel thereto and having the coils thereof interengaged with the endmost coils of the continuous coil springs extending between the first set of opposite margins, said edge reinforcers associated with the first set of opposite margins having the straight connector portions thereof located outwardly from the coils thereof and secured to the border wires in an adjacent relationship;

the edge reinforcers associated with the second set of opposite margins extending parallel thereto and having the coils thereof interengaged with the coils of the continuous coil springs adjacent the second set of opposite margins, and the edge reinforcers associated with the second set of opposite margins having the straight connector portions thereof located outwardly from the coils thereof and secured to the border wires in an adjacent relationship;

and wherein the edge reinforcers comprise a continuous coil spring of a unitary construction that extends completely around the first and second opposite margins of the assembly.

10. A spring assembly of a generally rectangular shape having first and second sets of opposite margins, the spring assembly comprising:

a plurality of continuous coil springs each of which includes a plurality of coils made unitary with each other from a continuous strand of wire;

said continuous coil springs extending between the first set of opposite margins of the spring assembly in a parallel relationship to each other and to the second set of opposite margins;

continuous coil edge reinforcers for the first and second sets of opposite margins of the spring assembly;

each of said continuous coil edge reinforcers including a plurality of coils made unitary with each other from a continuous strand of wire;

the coils of each continuous coil spring and edge reinforcer including loops that receive the loops of the associated spring in an interlocking fashion and also including straight connector portions that connect the loops thereof and are aligned with each other in a laterally spaced relationship on one side of the coils;

the continuous coil edge reinforcers associated with the first set of opposite margins extending parallel thereto with the coils thereof interengaged with the endmost coils of the continuous coil springs extending between the first set of opposite margins;

the continuous coil edge reinforcers associated with the second set of opposite margins having the straight connector portions thereof located outwardly from the coils thereof;

and a pair of rectangular border wires secured to the continuous coil springs and the edge reinforcers;

and wherein at least one of the continuous coil edge reinforcers associated with the second set of opposite margins is constructed unitarily with the same strand as at least one of said continuous coil edge reinforcers associated with said first set of opposite margins.

* * * * *